US005900561A

United States Patent [19]

Wechter

[11] Patent Number: 5,900,561

[45] Date of Patent: May 4, 1999

[54] GUITAR WITH IMPROVED HEADBLOCK AND TAILBLOCK

[76] Inventor: Abraham J. Wechter, 34654 32nd St., Paw Paw, Mich. 49079-9516

[21] Appl. No.: 08/906,761

[22] Filed: Aug. 5, 1997

Related U.S. Application Data

[63] Continuation of application No. 08/408,702, Mar. 22, 1995, abandoned.

[51] Int. Cl.[6] ..... G10D 1/08

[52] U.S. Cl. ..... 84/267; 84/291; 84/293

[58] Field of Search ..... 84/291, 292, 267, 84/329; D17/14

[56] References Cited

U.S. PATENT DOCUMENTS

| | | | |
|---|---|---|---|
| D. 340,737 | 10/1993 | Sandberg | D17/14 |
| 474,120 | 5/1892 | Ganss | 84/291 |
| 653,521 | 7/1900 | Montoya | 84/291 |
| 767,023 | 8/1904 | Turturro | 84/291 |
| 812,049 | 2/1906 | Krueger | 84/291 |
| 906,612 | 12/1908 | Cayton | 84/291 |
| 964,660 | 7/1910 | Laurian | 84/291 |
| 1,764,679 | 6/1930 | Gast | 84/291 |
| 2,660,912 | 12/1953 | Prescott | 84/291 |
| 3,911,778 | 10/1975 | Martin | 84/291 |
| 4,027,570 | 6/1977 | Rendell et al. | 84/291 |
| 4,169,402 | 10/1979 | Wood | 84/291 |
| 4,313,362 | 2/1982 | Lieber | 84/291 |
| 4,351,217 | 9/1982 | Wechter | 84/291 |
| 4,359,923 | 11/1982 | Brunet | 84/291 |
| 4,616,550 | 10/1986 | Lacroix et al. | 84/291 |
| 4,856,403 | 8/1989 | Davies | 84/291 |
| 4,881,441 | 11/1989 | Larsen | 84/291 |
| 4,905,563 | 3/1990 | Davies | 84/291 |

OTHER PUBLICATIONS

Mozzani publication "Arts and Crafts", selected pages (6 pages) Date Unknown.

Book entitled "Guitares", selected pages (11 pages), Paris, France Date Unknown.

Photographs A and B and Drawings A and B showing a "Gibson Style O" guitar (3 pages) Date Unknown.

Photographs A and B of a solid body guitar Date Unknown.

Photographs A and B of a hollow body guitar Date Unknown.

"Elderly Visits the Rickenbacker Factory & Museum" (1 page) Date Unknown.

Photographs A and B of a Rickenbacker guitar Date Unknown.

Brochure "The 600 Series" Rickenbacker International Corporation, 1993, (6 pages).

Brochure "The 200 Series" Rickenbacker International Corporation, 1993, (4 pages).

Madolin Brothers Ltd. 1994 Catalog, selected pages, (14 pages).

*Primary Examiner*—William M. Shoop, Jr.
*Assistant Examiner*—Kim Lockett
*Attorney, Agent, or Firm*—Flynn, Thiel, Boutell & Tanis, P.C.

[57] ABSTRACT

An acoustical guitar having a hollow main body forming a sound box and defined by top and bottom walls joined by a side rim. A long cantilevered neck is attached to the hollow main body adjacent a head end thereof and projects outwardly therefrom. A headblock arrangement at the head end fixedly attaches a heel end of the neck to the hollow main body. The headblock arrangement comprises a one-piece U-shaped headblock positioned between and fixedly connected to the top and bottom walls at the head end. The U-shaped headblock defines a concave recess which projects longitudinally inwardly of the hollow body at the head end. The neck projects into the concave recess with the heel end of the neck disposed within the recess and fixedly secured to the U-shaped headblock. A pair of access spaces are defined by the recess on opposite sides of the neck. The hollow main body also preferably includes a recessed tailblock assembly having a removable cover disposed over an opening which opens into the interior of the hollow body.

21 Claims, 6 Drawing Sheets

GUITAR WITH IMPROVED HEADBLOCK AND TAILBLOCK

This application is a continuation of U.S. Ser. No. 08/408 702, filed Mar. 22, 1995 abandoned.

FIELD OF THE INVENTION

This invention relates to a stringed musical instrument and more particularly to improvements in tailblock and headblock arrangements for a hollow-body guitar.

BACKGROUND OF THE INVENTION

In a hollow-body guitar, such as an acoustical guitar having a sound hole formed in the top wall (i.e., sounding board) of the hollow body, the elongate neck of the guitar connects to the front or head end of the hollow body by a headblock arrangement which is fixed to the front end wall of the hollow body. This headblock arrangement normally includes an enlarged headblock disposed interiorly of the hollow body but fixed to the front end wall substantially at the center thereof, and the inner end of the neck is fixedly secured to the headblock, typically by means of an interfitting dovetail groove arrangement, bolts or glue. The tensioned strings extend along the upper face of the elongate neck and are secured adjacent the remote free end thereof, with the other ends of the strings being secured to the hollow body. Due to the tension in the strings and the raised position thereof relative to the connection of the neck to the headblock, a significant force moment is imposed on the connection between the neck and the headblock, and it has been observed that this force moment over time causes undesired distortion of the guitar.

Due to the necessity of providing a compliant soundboard and body, acoustic guitars are necessarily built of relatively thin planar elements, with internal and external reinforcing structure added only where necessary. This construction often requires several parts of the guitar to work together to provide sufficient structural integrity. The headblock alone typically forms only part of the structure necessary to reinforce the guitar body against the force moment of the neck; typically there is also a substantial length of fingerboard glued to the external surface of the soundboard, as well as internal reinforcing bracing glued to the soundboard under it. Despite this construction, the headblock in many guitars rotates over time as a result of the force moment of the neck, causing difficultly in playing.

At the neck end, the vibrating portion of the string rests on a support called the nut, and at the body end, the vibrating portion of the string, where the strings transmit vibration to the soundboard, rests on a support called a saddle which is mounted in a bridge. For a given string length, the distance from the nut and bridge to any specific fret is constant to within an extremely small variable. Thus, the fret at which the neck is joined to the body effectively locates the bridge on the soundboard, and an increased extension of neck outside the body, giving access to additional frets, locates the bridge closer to the neck joint area and soundhole. Since the proximity of the bridge to the other elements of the guitar has an effect on the tone of the instrument, there is an optimum range within which the bridge must be located. This range determines the fret at which the neck and body can be joined.

The soundhole of most, but not all, flattop guitars is bisected by the longitudinal central axis defined by the strings. The distance of the soundhole to the bridge affects the tonal response of the guitar, and it can be only partially covered by the fingerboard, if at all. Additionally, any internal structure on the inside surface of the soundboard to support the neck joint or fingerboard must not protrude under the open area of the soundhole for aesthetic as well as structural reasons.

Players desire access to as much of the playing surface of the fingerboard as possible. In order to maintain an acoustically appropriate bridge location, while still providing extended fingerboard access, a portion of the body of the guitar adjacent to the fingerboard is sometimes removed from the design of the instrument. This area, called the "cutaway", is necessarily in close proximity to the neck joint, and its design is constrained by the substantial structural requirement of this area.

There are designs in which the body of the guitar is formed by hollowing out a solid plank of wood and adding a top or back to form an internal cavity. While such guitar bodies can be formed to provide excellent access to upper portions of the fingerboard, they are necessarily of relatively heavy construction, due to the weak nature of end grain wood when reduced to a thin cross section. As such, these instruments are primarily suitable for electronic amplification, and the "acoustic" response function acts as a tonal modifier of the primary amplified sound. Obsolete designs and primitive folk instruments of similar "hollowed out" construction also exist, but they suffer from the aforementioned structural and/or tonal deficiencies, and are therefore not effective in producing reliable and responsive acoustic guitars by modern standards.

In previous attempts to provide access to upper portions of the fingerboard, constructions have been used that combine an internal headblock, to which the neck is fastened, with a relatively thin outer sidewall, typically approximately similar in thickness to the soundboard and back, which outer wall defines the external shape of the body of the instrument. A similar alternative method of construction utilizes a portion of the neck itself that extends into the body as the structural equivalent of a headblock.

In such constructions the headblock, or the portion of the neck extending inside the body, is a separate piece from the outer wall, and is adhesively fastened to only part of the inside of the outer wall or walls that define the neck end of the guitar body. Thus any structural rigidity which may be gained by the physical configuration of the relatively thin outer wall is compromised to some degree by it's flexibility. This flexibility requires the presence of other mechanical factors, such as an internal reinforcement structure, and possibly also a length of fingerboard bearing on the external surface of the soundboard to withstand the leverage of the neck.

Because of these requirements, most acoustic guitar designs that attempt to provide extended fingerboard access are not able to provide unimpeded access to the back of the neck in the extended access area, but provide only lateral access, retaining to some degree a supportive structure under the fingerboard in the extended access area.

There are pre-existing acoustic guitar designs in which the neck joins the body in the approximate center of an inwardly curved structure, so called "lyre guitars". These are highly stylized instruments in which hollow chambers extend parallel to the neck, on either side of it; in most cases there are connections between these long chambers and the peghead (the attachment point of the strings at the outer end of the neck). These long chambers are primarily ornamental and to a lesser degree acoustical in function, but they are not designed to stabilize the neck joint area of themselves, being constructed with relatively thin sidewalls. As such there is a separate headblock, or internal neck extension, in conjunction with internal bracing and a cross connection between the long side chambers and the peghead to help provide the required structural support for the neck. Because of the required internal construction to reinforce the neck joint area, the soundhole, or soundholes must be located to accommodate this construction.

Another problem experienced with hollow-body guitars, which problem is wholly nonrelated to the headblock problem discussed above, relates to the construction of the tailblock assembly so as to facilitate access to the interior of the hollow body, such as for maintenance or for mounting and accessing electronics. One attempt to facilitate access to the interior of the hollow body through the tailblock assembly involves the provision of a hollow ring-shaped tailblock having a removable access door or cover, as disclosed in my earlier U.S. Pat. No. 4,351,217. While the tailblock assembly of my '217 patent does provide desirable access to the interior of the hollow body while at the same time retaining the desirable strength and acoustic properties of the hollow body, nevertheless this earlier tailblock arrangement still possess disadvantages, particularly with respect to manufacturing complexities and costs. In this known tailblock assembly, the ringlike tailblock member is of a laminated construction and has an arcuate configuration or curvature corresponding to that of the rear end wall of the hollow body, and this makes manufacture of the tailblock member and assembly thereof to the guitar more costly and complex than desired. Also, this arrangement requires that the access door be recessed within the tailblock in order to recess electronic components.

Accordingly, it is an object of this invention to provide improved headblock and tailblock arrangements for a hollow-body guitar, which arrangements overcome the disadvantages associated with prior arrangements of this general type, as briefly discussed above.

More specifically, it is an object of this invention to provide an improved headblock arrangement having increased capability of withstanding the force moment created by the strings of the instrument, without detracting from either the acoustical properties of the hollow body or the overall appearance of the guitar.

A further object is to provide an improved headblock arrangement, as aforesaid, which provides the user with increased access to the strings located more closely adjacent the hollow body.

It is also an object of the invention to provide an improved tailblock arrangement which provides access to the interior of the hollow body for maintenance or for mounting electronics, but which arrangement can be economically manufactured and assembled to the hollow body, which permit the exterior electronic components to be desirably recessed, and which does not detract from the overall appearance of the guitar.

Still a further object of the invention is to provide an improved hollow-body guitar wherein incorporation of both the improved headblock arrangement and the improved tailblock arrangement provides the overall guitar with not only improved structural characteristics but also provides the guitar with a desirable appearance.

The stringed musical instrument of this invention includes a hollow body having top and bottom walls joined by a peripheral rim or sidewall, the top wall preferably having a hole therethrough and functioning as a sounding board. An elongate neck member is fixed to and projects outwardly from the guitar in the longitudinal direction thereof, and a plurality of tensioned strings extend along the upper surface of the neck member, with one end of the strings being anchored adjacent the free or head end of the neck member. The other end of the strings are anchored to the hollow body. The rear or tail end of the neck member is fixedly anchored to the front or head end of the hollow body by a headblock arrangement. In the guitar of this invention, the head end of the hollow body is formed with a front end wall having a concave arcuate configuration which defines a large concave recess which opens outwardly in the forward direction. This recess is substantially bisected by the neck member as it projects longitudinally outwardly from the hollow body. The headblock arrangement includes a headblock which effectively defines the front end wall of the hollow body and is of a concave arcuate configuration, with the tail end of the neck member being fixed to this headblock substantially at a center portion thereof. The arcuate configuration of the headblock defines side or wing portions which project sidewardly and forwardly from the center portion so as to terminate in free ends or tip parts which are spaced longitudinally forwardly a substantial distance from the center portion. This creates a significant torsional or moment strength in the longitudinal direction of the guitar to resist the longitudinal force moment created by the strings. The concave recess defined at the head end of the guitar also provides increased access space for the user's hands to facilitate access to the strings at a location closer to the sound hole, that is, to facilitate access to the higher frets.

The stringed musical instrument of the invention also comprises a hollow-body guitar having the general construction briefly described above, preferably including the improved headblock arrangement briefly described above, and also incorporating a slotlike recess or opening which is formed in the rear or tail end of the hollow body and projects longitudinally inwardly a small extent. This recess is formed through the top and bottom walls, and the sides of the recess are formed by opposed wall parts defined on a U-shaped tailblock which defines at least part of the rear end wall of the hollow body. The tailblock includes a hollow ringlike block part which is of a generally flat configuration and is mounted in longitudinally forwardly spaced relation from the remote or rearward end of the hollow body. This ringlike block part, on the rear race thereof, mounts a removable door or access panel to facilitate access to the interior of the hollow body, either for purposes of maintenance or for permitting mounting of or access to an electronic pick-up and associated electronics and controls.

In the instrument of this invention, the sidewall which defines the neck end of the guitar is constructed of laminated wooden veneer or of a synthetic material. It is inwardly curved, and the neck attaches directly to it. It is of sufficient strength so that it alone provides all, or virtually all of the structural rigidity necessary. Internal structure is kept to a minimum, and because of the rigid nature of the end wall itself, it's reliance on any internal reinforcement disposed towards the bridge is minimal or nonexistent. This minimal internal construction allows the neck to join the body closer to the soundhole and bridge without requiring any adaptation of their location relative to the rest of the guitar body. This construction also does not depend on any downbearing pressure of the fingerboard to stabilize the neck against rotation. This allows the portion of the fingerboard over the body to be extremely short, and frees it of any required adhesive or mechanical fastening to the soundboard. The neck may be removable from the body by simply unbolting it from the curved headblock. Additionally, because no supportive structure is required under the extended access area of the neck, there is full access to the back of the neck in this area.

Other objects and purposes of the invention will be apparent to persons familiar with instruments of this general type upon reading the following specification and inspecting the accompanying drawings.

Figure 1:
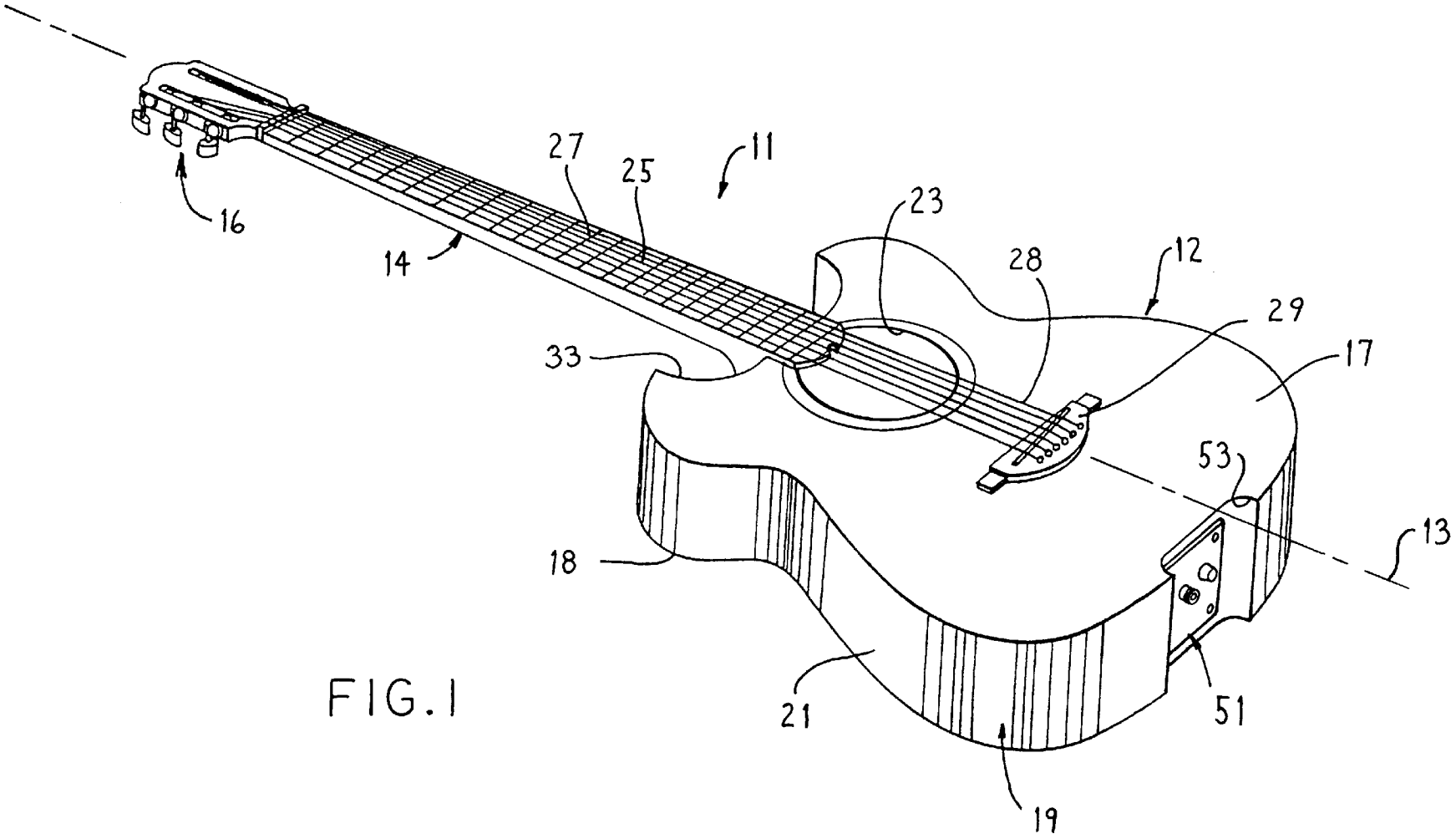
FIG. 1 is a perspective view of a stringed musical instrument, specifically an acoustical guitar according to the invention.
Figure 2:
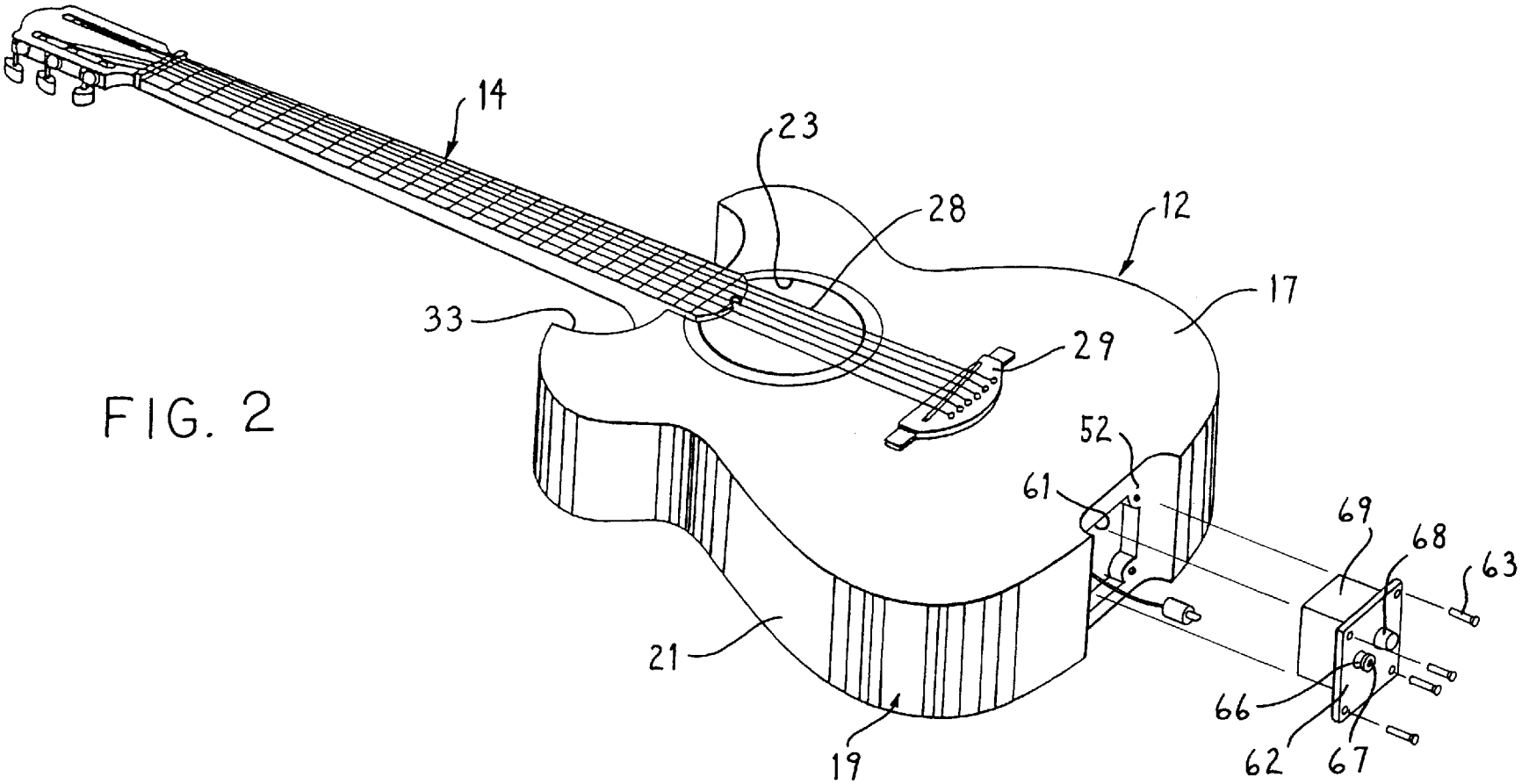
FIG. 2 is a perspective view similar to FIG. 1 but showing the access panel separated from the tailblock.

Certain terminology will be used in the following description for convenience in reference only, and will not be limiting. For example, the words "upwardly", "downwardly", "rightwardly" and "leftwardly" will refer to directions in the drawings to which reference is made. The word "front" will refer to the end of the main body of the guitar from which the neck projects, this being the leftward end in the drawings, and the word "rear" will refer to the opposite end of the main body of the guitar. The words "inwardly" and "outwardly" will refer to directions toward and away from, respectively, the geometric center of the instrument and designated parts thereof. Said terminology will include the words specifically mentioned, derivatives thereof, and words of similar import.

DETAILED DESCRIPTION

Referring to the drawings, there is illustrated a stringed instrument 11 commonly referred to as an acoustical or hollow guitar. As is conventional, the guitar 11 includes a main hollow body 12 which is typically, but not necessarily, symmetrical relative to the longitudinally-extending axis or centerline 13. An elongate neck 14 is fixed to the head or neck end of the hollow body 12 and is cantilevered outwardly therefrom in parallel relationship with, and in the illustrated embodiment aligned with, the longitudinal axis 13. A conventional peghead or tuning section 16 is associated with the free end of the neck.

The hollow body 12, in the illustrated embodiment, includes a generally flat top wall 17, normally referred to as the sounding board, disposed in superimposed but spaced relationship with a bottom wall 18. The top and bottom wall are joined together in spaced relation by a curved continuous rim or sidewall 19, the latter including opposed sidewall or rim portions 21 and 22 which are substantially mirror images of one another and are located on opposite sides of the hollow body. Typical corner pieces or strips 24 are provided at the junction between the edges of the sidewall portions 21 and 22 and the edges of the top and bottom walls 17 and 18.

As is conventional, the sounding board 17 is provided with a central hole 23.

The elongate neck 14 has a fingerboard 25 fixed to the upper surface thereof, which fingerboard typically includes at the inner end thereof a cantilevered extension 26 (FIG. 4) which overlies the sounding board and projects toward the sound hole 23. This fingerboard extension 26, in some situations, may even project partway over the sound hole. A plurality of small ribs 27, known as frets, are provided on and project outwardly from the fingerboard 25 at spaced intervals therealong. The elongate strings 28 of the guitar extend along the fingerboard 25 and are anchored at one end thereof to the tuning section 16, and in the illustrated embodiment are anchored at the other end to a bridge 29 which is fixedly secured to the sound board 17 at a location rearwardly from the sound hole so that the strings extend across the sound hole.

While the illustrated embodiment shows the strings anchored to the bridge, it will be recognized that it is conventional to also anchor the tail end of the strings to a tailpiece which in turn is anchored adjacent the tail end of the guitar, such being illustrated in my aforementioned U.S. Pat. No. 4,351,217.

While the description above relates to a flat top guitar, it is also equally applicable to an arched top guitar wherein the top wall or sound board is provided with a rounded or arched configuration.

Figure 3:
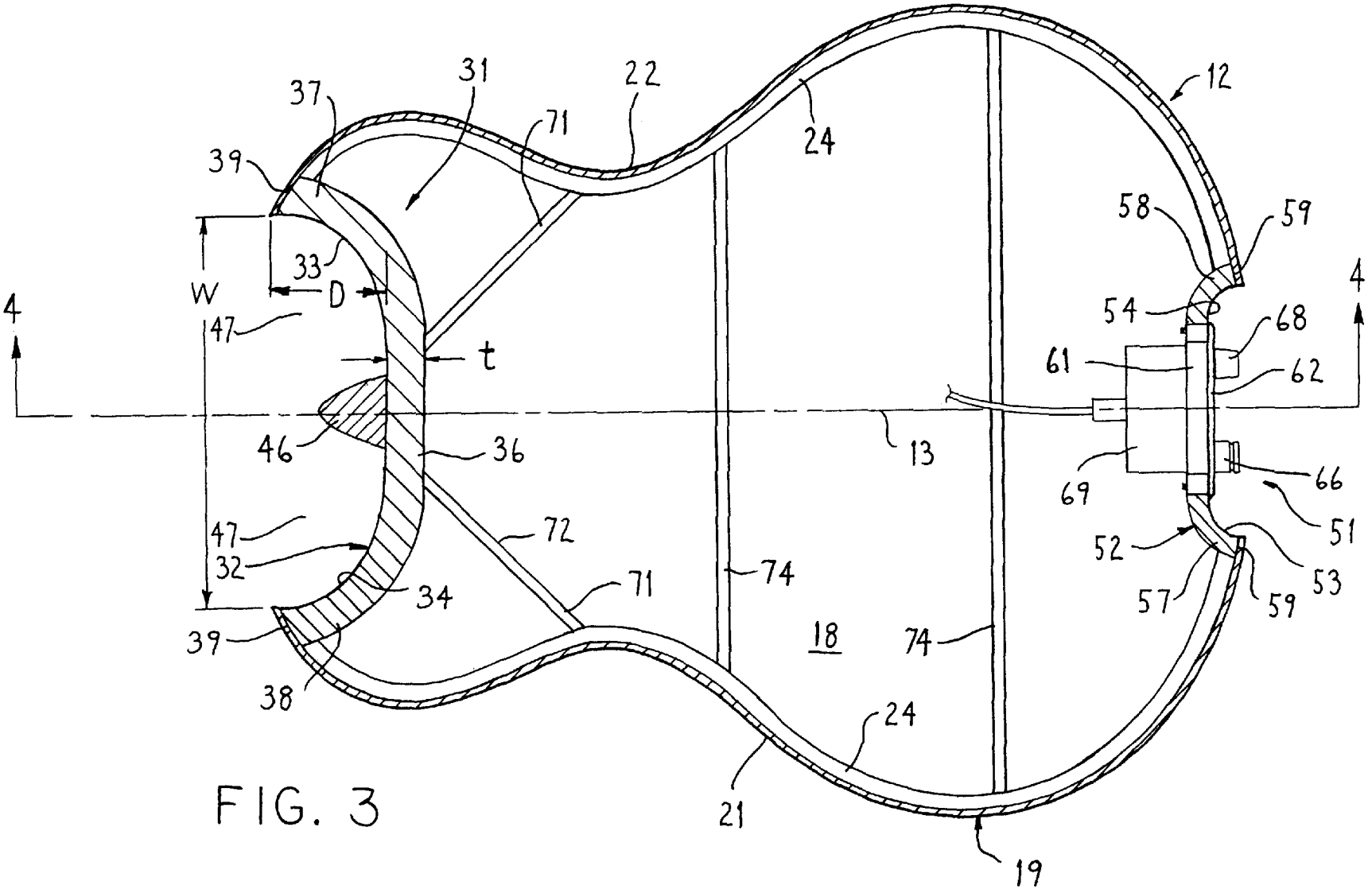
FIG. 3 is an enlarged, fragmentary sectional view taken generally along line 3—3 in FIG. 4.
Figure 4:
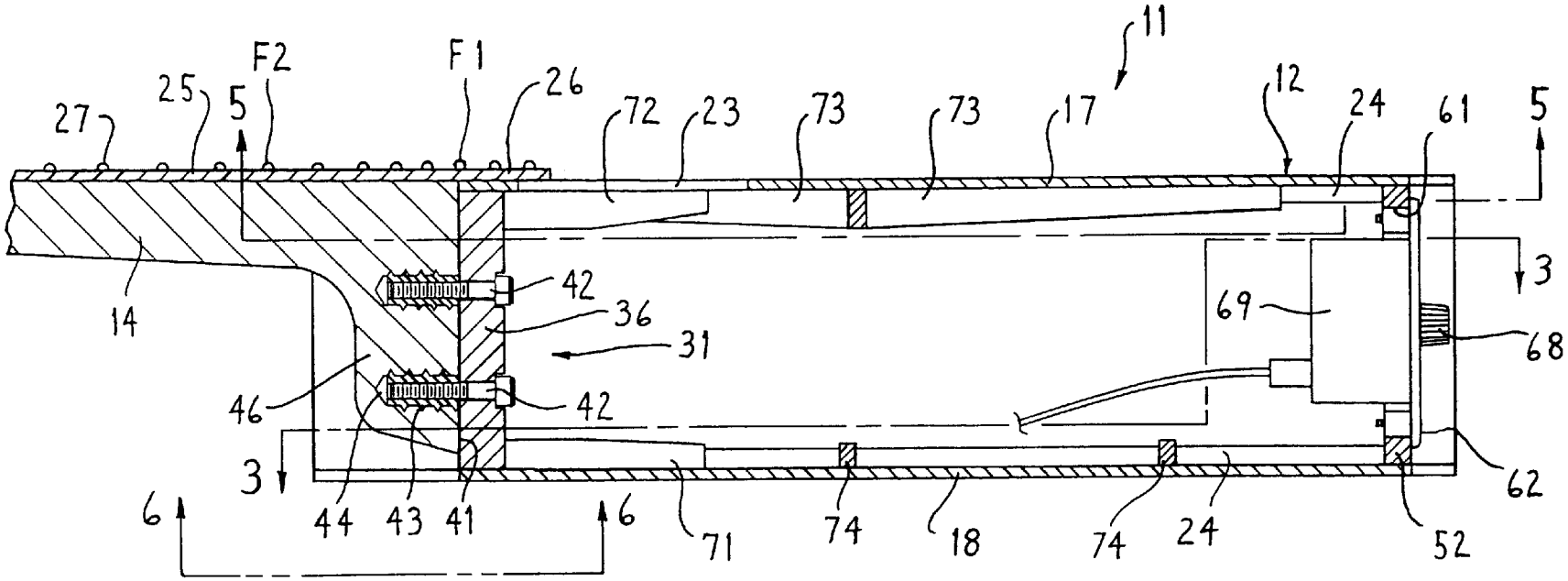
FIG. 4 is a fragmentary sectional view taken generally along line 4—4 in FIG. 3.
Figure 5:
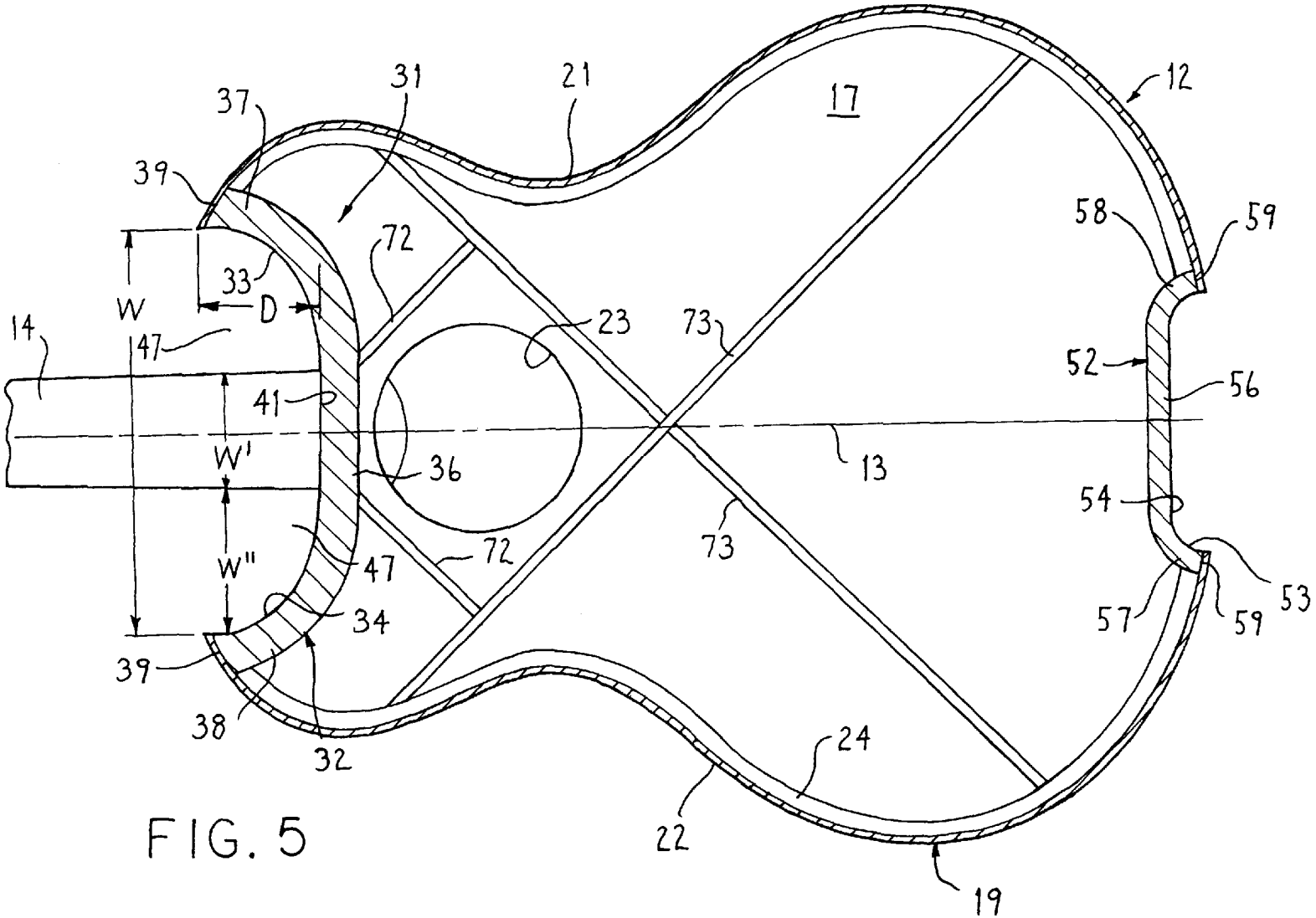
FIG. 5 is a fragmentary sectional view taken generally along line 5–5 in FIG. 4.
Figure 6:
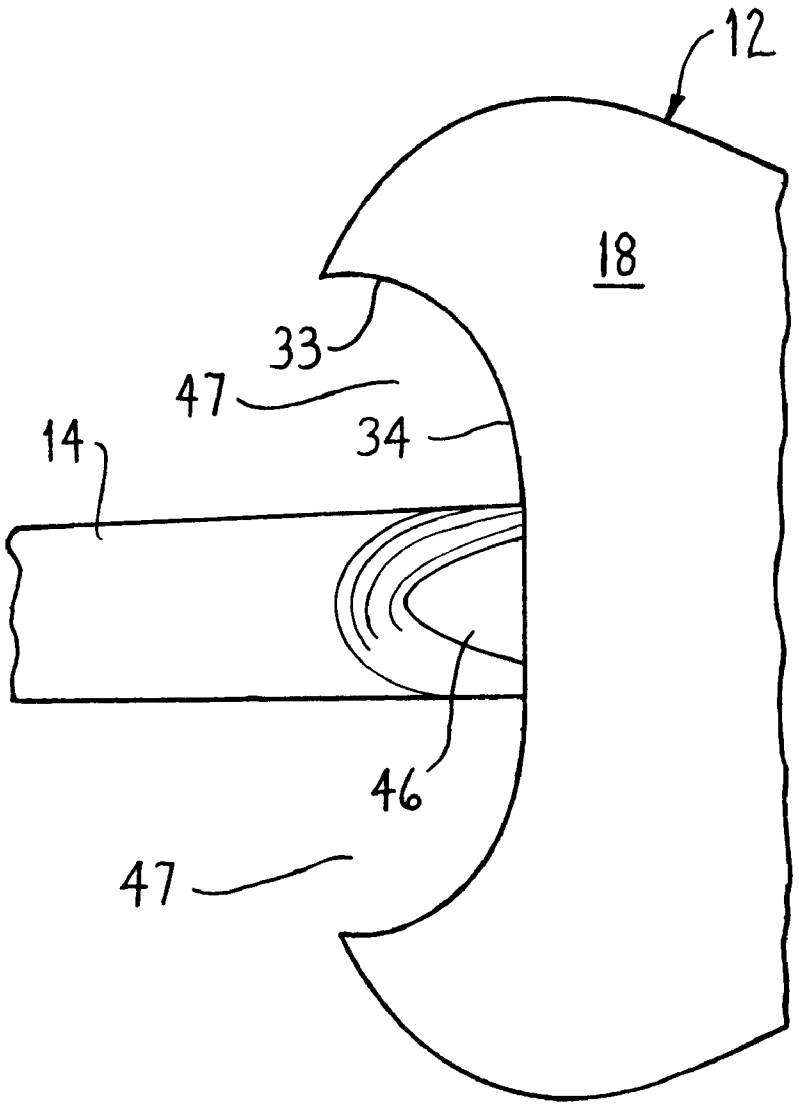
FIG. 6 is a fragmentary view taken generally along line 6—6 in FIG. 4.

The guitar of the present invention, as illustrated by FIGS. 3–5, includes an improved headblock arrangement 31 for permitting securement of the neck 14 to the hollow body 12. The improved headblock arrangement 31 is developed specifically to resist the torsional or moment force imposed at the headblock region due to the tension of the raised strings.

The headblock arrangement 31 specifically includes a one-piece headblock 32 which is of a generally shallow U-shaped configuration and is disposed so as to extend between the top and bottom walls 17 and 18 at the head end of the guitar, with the headblock 32 being fixedly secured to and between the top and bottom walls 17 and 18. The U-shaped configuration of the headblock 32 defines therein a generally concave recess 33 which opens longitudinally outwardly at the head end of the hollow body toward the free end of the neck. This concave recess 33 as defined by the headblock 32 is also formed in the top and bottom walls 17 and 18, so that the concave recess projects entirely through the hollow body at the head end thereof, with the recess being defined by the concave exterior wall 34 of the headblock 32.

The concave recess 33 is effectively bisected by the longitudinal axis 13, and hence is also effectively bisected by the outwardly projecting elongate neck 14.

The one-piece headblock 32 includes a generally flat center or bight part 36 which is substantially intersected by and projects perpendicularly with respect to the longitudinal axis 13, and this flat center part 36 at opposite ends is integrally joined to curved or arcuate leg parts 37 and 38 which project sidewardly in opposite directions but which are both curved through an angle which approaches 90° so as to project generally forwardly toward the free end of the neck 14. These arcuate leg parts 37 and 38 are identical and terminate in free ends 39 which effectively abut and are fixedly secured to the forward free ends of the peripheral sidewall portions 21 and 22, such as by gluing or adhesive securing therebetween. The one-piece headblock 32 thus effectively cooperates with the sidewall portions 21 and 22 so as to define a continuous sidewall or rim for the hollow body at the head end thereof. That is, the headblock 32 defines the front end wall of the continuous rim 19.

The neck 14 is provided with an end surface 41 at the inner end thereof, which end surface 41 abuts the flat outer surface of the flat center part 36. The inner end of the neck is fixedly secured to the flat center part 36 of the headblock 32, and in the illustrated embodiment a pair of vertically-spaced but generally parallel threaded fasteners such as bolts 42 (FIG. 4) extend from interiorly of the hollow body through the flat center part 36 and are anchored to nuts 43 which are fixedly positioned within bored openings 44 formed in the enlarged mounting or heel part 46 as provided at the tail end of the neck 14. If necessary or desired, glue can also be provided between the opposed surfaces of the heel part 46 and the center part 36. The use of threaded fasteners and/or glue for securing the neck to the headblock is conventional.

The concave recess 33 defined by the headblock 32 has a width W as measured perpendicularly with respect to the longitudinal axis 13 which is several times greater than the depth D of the recess. Typically the width W is preferably at least about three times the depth D. This width W is also significantly greater than the typical width W' of the neck 14 and fingerboard 25. Thus, as the neck and fingerboard project outwardly through the recess 33 in substantially intersecting relationship therewith, this thus results in the defining of significant access spaces 47 on opposite sides of the neck, which access spaces are each defined between one side of the neck and the respective opposed arcuate leg part 37 or 38, with these access spaces 47 opening inwardly of the hollow body from the head end thereof toward the tail end. These access spaces 47 typically have a width W' which is at least equal to or slightly greater than the neck width W', with the width W" normally being at least about 2½ to 3 inches. This greatly facilitates access to the frets 27 located more closely adjacent the sound hole 23. For example, with the arrangement of the present invention, the fret designated F1 in FIG. 4, which fret is disposed adjacent the base of the exterior wall 34 of the concave recess, will typically be about the 18th or 19th fret. This is in contrast to a conventional guitar wherein the fret closest to the head end of the hollow body will typically be about the 14th or 15th fret, the 14th fret being designated F2 in FIG. 4.

In addition to the access spaces 47 described above, the free ends 39 of the U-shaped headblock 32 are spaced longitudinally outwardly by a significant distance, such as the distance D in FIG. 3, from the interface between the heel surface 41 and the center part 36. This longitudinal distance D, coupled with the overall configuration of the U-shaped headblock 32 including the significant sideward spacing between the arcuate side leg parts 37 and 38, enables the headblock 32 and its connection to the remaining walls of the hollow body to possess significant torsional resistance in the longitudinal direction of the guitar, and hence can readily and rigidly withstand the torsional force imposed thereon by the raised tensioned strings without subjecting the guitar to undesired distortion.

To further improve the strength and hence torsional resistance provided by the improved headblock arrangement 31, there is further preferably provided braces which are disposed interiorly of the hollow body 12 and connect to the headblock member 32, preferably adjacent the upper and lower edges thereof.

In the preferred and illustrated embodiment, a pair of bottom braces 71 (FIG. 3) are provided in generally symmetrical relationship on opposite sides of the longitudinal axis 13. Each bottom brace 71 has one end thereof fixedly anchored, as by being disposed within a shallow recess or opening, to the flat center part 36 of the headblock 32, and the bottom brace 71 projects outwardly (i.e. rearwardly) therefrom in angled relationship relative to the axis 13 so that the other end of this bottom brace 71 terminates at and is anchored relative to the respective sidewall portion 21 or 22, such as by being engaged with the corner piece 24. The pair of bottom braces 71 are disposed substantially in engagement with the bottom wall 18, and in fact can be glued thereto. These braces at their forward ends engage the interior side of the headblock 32 adjacent the lower edge thereof, and in sidewardly spaced relationship on opposite sides of the axis 13, whereby the pair of bottom braces 71 angle (i.e. diverge) outwardly relative to the axis 13 and relative to one another as they project rearwardly. These braces are preferably outwardly angled at an angle in the neighborhood of about 45° relative to the longitudinal axis 13.

A further pair of top braces 72 (FIG. 5) are provided and cooperate with the upper edge of the headblock 32, with these top braces 72 being spaced vertically upwardly above but otherwise being positioned generally the same as the bottom braces 71. That is, each top brace 72 preferably has the front end thereof positioned within a recess formed in the headblock 32, and the pair of top braces 72 angle or diverge outwardly relative to one other and relative to the axis 13 as they project rearwardly, with the braces 72 preferably angling outwardly at an angle in the neighborhood of about 45° relative to the axis 13, whereby the included angle between the pair of braces 72 as well as the angle between the pair of braces 71 is in the neighborhood of about 90°. The top braces 72 are positioned directly adjacent and preferably engage, and in fact can be glued to, the underside of the top wall 17. The outer or rearward ends of the top braces 72, however, abut or are anchored to X-braces 73 which are provided directly under the top wall 17 and oppositely diagonally intersect the hollow body 12 directly under the top wall. The opposite ends of these X-braces 73 are suitably anchored to the uppermost corner pieces 24. The X-braces 73 are conventional in the construction of hollow-body guitars.

In addition, bottom cross braces 74 (FIG. 3) are positioned in engagement with the interior surface of the bottom wall 18 and extend perpendicularly across the hollow body between the opposed sidewalls, typically two or more such bottom cross braces being provided. Such bottom cross braces are conventional.

Other than the top and bottom braces as discussed above, which braces do not protrude significantly into the interior of the hollow body 12, as illustrated by the braces shown in FIG. 4, the interior of the hollow body 12 is otherwise entirely open to hence function as a desired acoustical chamber for providing desirable sound properties when the instrument is played.

The improved guitar of the invention, as illustrated by FIGS. 2–5, also preferably incorporates an improved tailblock arrangement 51 associated with the hollow body thereof. This tailblock arrangement 51 includes a one-piece tailblock 52 which is preferably of a shallow U-shaped configuration and defines a concave recess 53 which opens inwardly at the tail end of the hollow body. The tailblock 52 extends vertically between and is fixedly secured, as by gluing, to the top and bottom walls 17 and 18, which walls also have the concave recess 53 formed therein so that this recess projects vertically through the entire thickness of the hollow body and is defined by the exterior wall 54 of the tailblock 52.

The one-piece tailblock 52 has a generally flat or platelike center part 56 which is substantially bisected by the longitudinal axis 13 and projects perpendicularly in opposite directions therefrom, with this flat center part 56 at opposite ends being integrally joined to curved or arcuate leg parts 57 and 58. These leg parts 57 and 58 project sidewardly in opposite directions and curve rearwardly toward the tail end of the guitar, and terminate in free ends 59 which are fixedly joined to the rearward ends of the sidewall portions 21 and 22.

With the construction of the tailblock 52 as described above, the one-piece U-shaped tailblock 52 hence forms a continuous construction with the sidewall portions 21 and 22 of the hollow body, and thus defines at least part of the rear end wall which is part of the continuous rim 19.

The center part 56 of the tailblock 52 has an enlarged opening 61 extending transversely therethrough into the interior of the hollow body, which opening 61 approaches a rectangular opening. A substantially rectangular access panel or cover 62 abuts the exterior wall 54 of the center part 56 so as to close off the opening 61. A plurality of fasteners such as screws 63 secure the cover 62 to the tailblock 52, there being four such screws 63 provided adjacent the corners of the cover in the illustrated embodiment.

The cover 62 is generally a relatively thin plate-like member which, when abutted against the face of the tailblock 52, is disposed substantially entirely within the longitudinal depth of the recess 53, as illustrated by FIG. 3.

The cover 62 may be provided with various elements thereon. For example, the cover will typically be provided with a conventional strap holder 66 mounted thereon and projecting therefrom for securing one end of a support strap thereto. The cover 62 may also be utilized for mounting electronic components such as when the guitar is to be provided with amplifying electronics or the like. For example, a jack 67 can be provided on the cover (in this illustrated embodiment the jack is part of the holder 66), and likewise an adjustable volume-control knob 68 can also be provided on the cover, both being accessible from the exterior side of the cover 62. The jack 67 and volume knob 68 in turn connect to conventional electronic components, as indicated at 69, which can be mounted to the inner side of the cover 62, as also disclosed in my earlier U.S. Pat. No. 4,351,217.

The removable cover 62 hence provides quick and convenient access to not only the interior of the hollow body, but also any components mounted on the interior side of the cover, such as a replaceable battery. At the same time, however, the U-shaped tailblock 52 and the recess 53 defined thereby in the tail end of the hollow body results in any such components, such as the strap holder 66, the jack 67 or the volume knob 68, being effectively recessed or disposed within the recess 53, thereby not only improving the overall appearance of the guitar by partially recessing these components, but also providing protection therefor since the recessing thereof minimizes the possibility that these components will be accidentally damaged by contact with other structures.

The guitar of the present invention is hence provided with an improved headblock arrangement which effectively reinforces the guitar body against destructive deformation from string pressure, and at the same time extends comfortable access to a higher portion of the fingerboard than is available with current acoustic guitar designs.

The guitar of the present invention, when provided with the improved tailblock construction, facilitates provision of an access panel in the tailblock, while also providing a protected recess for electronic controls.

In the guitar of this invention, as is generally conventional, the top and bottom walls 17–18 as well as the sidewall portions 21–22 will be of a thin sheetlike construction, typically having a thickness of about one-eight inch or less, although in an arched-top guitar the thickness of the top and bottom walls may be about one-fourth inch. The one-piece U-shaped headblock 32, however, has a thickness "t" which is several times greater than the thickness of walls 17, 18, 21 and 22. In a preferred embodiment, the headblock thickness "t"is at least about one-half to about three-fourths inch, and the side legs 37–38 have a length sufficient to project outwardly from the bottom of the recess by a distance at least equal to or greater about than "2t".

The headblock 32 in the illustrated embodiment is symmetrical on opposite sides of the longitudinal axis 13 (i.e., mirror images), and this provides desirable strength properties both longitudinally and transversely of the guitar. However, in situations where stylizing of the guitar dictates a nonsymmetrical configuration relative to the longitudinal axis, then in such case the side legs 37 and 38 of the headblock may be of different lengths, although each will have a minimal length sufficient to ensure proper strength of the guitar in terms of the headblock connection in both the longitudinal and transverse directions.

The headblock and tailblock according to the present invention, when constructed of wood, are preferably laminated out of wood veneer, although it will be appreciated that the headblock and tailblock can also be of a molded construction, such as by being molded of a plastic resin. The molding of the headblock and tailblock of a plastic resin is particularly desirable if the entire body of the guitar is also of a molded plastic construction. Further, in situations where the headblock is molded of a plastics material, then in such situation it will be recognized that the headblock need not be of a solid construction throughout the extent thereof, but molding allows the headblock to be of a ribbed or honeycomb construction if desired so as to facilitate molding and minimize usage of material, while at the same time still providing the necessary strength and rigidity.

The invention and specifically the one-piece headblock enables the headblock to effectively function as the sidewall of the hollow body at the neck end thereof, and hence defines a part of the continuous peripheral sidewall of the hollow body. It will be recognized, however, that in some situations the exterior surface of the peripheral sidewall or rim of the hollow body may require a special exterior appearance, such as for decorative or ornamental reasons. In such case the same thin sheetlike material which defines the side rim of the hollow body or at least the exterior surface thereof can also be applied to the outer concave surface of the one-piece headblock, such as by being bonded or laminated thereto, and such special decorative outer layer in effect will then constitute the outer surface of the one-piece headblock, and the latter in turn will still effectively define the sidewall of the hollow body at the neck end thereof.

While the invention as described above has referenced a flat top guitar, it will be recognized that the invention is also readily applicable to an arch-top guitar and a "f" hole guitar, as well as to a guitar where the strings attach to a tailpiece which mounts to the tailblock. In the present invention, such tailpiece could readily mount to the removable access panel or cover 62.

With the use of the improved headblock and tailblock arrangements of the invention, as described above, in addition to the structural and functional advantages provided thereby as summarized above, there is also provided a hollow-body guitar which is believed to possess a unique and desirable appearance due to the provision of the concave recesses which open outwardly in opposite directions from opposite ends of the hollow body, which recesses still retain the desired symmetrical appearance of the guitar relative to the longitudinal axis thereof, and also provide desirable design characteristics by providing similarly contoured concave recesses at opposite ends thereof.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a stringed instrument having a hollow main body forming a sound box, said hollow main body being defined by opposed top and bottom walls joined together by a continuous side rim and having a head end and a tail end at opposite locations on said side rim, a longitudinally elongate cantilevered neck attached to said hollow main body adjacent said head end thereof and projecting outwardly therefrom in substantially parallel relationship with a longitudinally extending axis which extends between the head and tail ends of said hollow main body, a plurality of strings extending along said neck and having opposite ends thereof attached to said neck and said main body, and a headblock arrangement at said head end of said hollow main body for fixedly attaching a heel part of said neck to said hollow main body, comprising the improvement wherein:

said headblock arrangement comprising a U-shaped headblock positioned between and fixedly connected to said top and bottom walls at said head end, said U-shaped headblock defining a concave recess which projects longitudinally inwardly of said hollow body at said head end in a direction toward said tail end, said recess also being formed in said top and bottom walls so as to extend transversely through the entire hollow body, said U-shaped headblock defining a part of said side rim, and said neck projecting into said concave recess, said neck at one longitudinal free end thereof terminating in a free terminal end which defines said heel part, the heel part of said neck being disposed within said recess, said heel part being abuttingly engaged with an outer front face of a bight part of said U-shaped headblock and fixedly secured thereto by a fastening arrangement which connects directly between said heel part and said bight part such that said neck is structurally fixedly secured to said hollow main body solely by said headblock and does not penetrate or extend through said headblock, said headblock having a pair of cantilevered side leg parts which join to opposite ends of said bight part and which project forwardly and are positioned in sidewardly spaced relation on opposite sides of said neck to define access spaces on opposite sides of said neck within said recess to facilitate access to the strings, said side rim having sidewall rim parts which extend longitudinally and define opposite sidewalls of the hollow main body, said U-shaped headblock having a thickness which is several times greater than the thickness of said sidewall rim parts, and each side leg part of the U-shaped headblock having a length so as to project outwardly in the longitudinal direction away from the bottom of the recess by a distance which is at least twice the thickness of the headblock so as to withstand the torsional loads imposed thereon by the neck due to the tension of the strings.

2. An instrument according to claim 1, including a pair of upper braces positioned within said hollow body adjacent the top wall and engaged with said headblock adjacent an upper edge thereof, the braces being sidewardly-spaced and disposed in a generally diverging V-shaped configuration as the braces project rearwardly from the headblock.

3. An instrument according to claim 1, wherein the bight part of said headblock is generally flat and projects approximately perpendicularly with respect to the longitudinal axis and which at opposite ends is integrally joined through smoothly curved corners to the pair of side leg parts so that the side leg parts project forwardly toward the free end of the neck and terminate in free ends which are disposed in sidewardly spaced relationship from opposite sides of the neck so as to define said access spaces therebetween, and said side rim including sidewall rim parts which extend longitudinally of and define opposite sidewalls of the hollow main body, said sidewall rim parts having front free ends thereof which are fixedly joined to the free ends of said side leg parts, whereby said U-shaped headblock and said sidewall rim parts define a continuous side rim construction for the hollow main body.

4. An instrument according to claim 3, wherein the heel part of the neck terminates in a generally flat and transverse end face which abuts the outer front face of the bight part of the headblock, and the fastening arrangement includes fasteners which penetrate the end face and extend between the heel part and the bight part for fixedly securing the neck to the headblock.

5. An instrument according to claim 3, wherein the access space as defined between each side of the neck and the adjacent side leg part of the headblock has a depth in the longitudinal direction which is of similar magnitude to a width as measured between the free end of the side leg part and the opposed adjacent side of the neck.

6. An instrument according to claim 3, wherein each said access space as defined between each side of the neck and the adjacent side leg part of the headblock has a width perpendicular to the longitudinal axis which is greater in magnitude than the width of the neck.

7. An instrument according to claim 3, wherein a pair of said upper braces and a pair of said lower positioned within said hollow body respectively adjacent the top and bottom walls and engaged with said headblock respectively adjacent upper and lower edges thereof, the braces of each pair being sidewardly-spaced and disposed in a generally diverging V-shaped configuration as the braces project rearwardly from the headblock.

8. An instrument according to claim 1, wherein said U-shaped headblock is of a substantially uniform thickness throughout the bight and side leg parts thereof, the thickness of said headblock being several times greater than the thickness of said top and bottom walls, and said sidewall rim parts having a thickness of a magnitude similar to the thickness of the top and bottom walls.

9. An instrument according to claim 1, wherein a fingerboard is secured to an upper surface of said neck and projects longitudinally rearwardly a small distance beyond a bottom of said recess in overlying relation to said top wall, said fingerboard defining a plurality of outwardly projecting frets thereon in longitudinally spaced relation therealong so that the bottom of said recess is disposed generally in alignment with a region of the fingerboard defined by the eighteenth to nineteenth frets.

10. A guitar according to claim 1, wherein said hollow main body includes a tail end opposite said head end thereof, said heel part of said neck and said tail end being disposed in longitudinally spaced relation and the tail end being free of any direct structural connection to the neck so that the hollow interior of the main body is free of obstructions between the tail and head ends which would significantly interfere with the acoustical properties of the instrument.

11. A guitar according to claim 1, wherein free ends of said side leg parts of said headblock define a forwardmost extremity of said hollow main body.

12. In a stringed instrument having a hollow main body forming a sound box, said hollow main body being defined by opposed top and bottom walls joined together by a continuous side rim and having a head end and a tail end at opposite locations on said side rim, a long cantilevered neck attached to said hollow main body adjacent said head end thereof and projecting outwardly therefrom in substantially parallel relationship with a longitudinally extending axis which extends between the head and tail ends of said hollow main body, a plurality of strings extending along said neck and having opposite ends thereof attached to said neck and said main body, and a headblock arrangement at said head end of said hollow main body for fixedly attaching a heel part of said neck to said hollow main body, comprising the improvement wherein:

said headblock arrangement comprising a U-shaped headblock positioned between and fixedly connected to said top and bottom walls at said head end, said U-shaped headblock defining a concave recess which projects longitudinally inwardly of said hollow body at said head end in a direction toward said tail end, said recess also being formed in said top and bottom walls so as to extend transversely through the entire hollow body, said U-shaped headblock defining a part of said side rim, and said neck projecting into said concave recess, the heel part of said neck being disposed within said recess and substantially defining a free end of said neck, said heel part being engaged with and directly fixedly secured to a bight part of said U-shaped headblock such that said neck is fixedly secured to said hollow main body substantially solely by said headblock which accommodates forces imposed thereon by said neck, said headblock having a pair of side leg parts which join to opposite ends of said bight part and which project forwardly and are positioned in sidewardly spaced relation on opposite sides of said neck to define access spaces on opposite sides of said neck within said recess to facilitate access to the strings, and a pair of braces fixed secured to and positioned within said hollow body and engaged at forward ends thereof with an interior side of said headblock, the braces being sidewardly-spaced and disposed in a generally diverging V-shaped configuration as the braces project rearwardly from the headblock interiorly of the hollow body.

13. An instrument according to claim 12, wherein the pair of braces are positioned adjacent the top wall and engage said headblock adjacent an upper edge thereof.

14. In an acoustical guitar having a hollow main body forming a sound box, said hollow main body being defined by opposed top and bottom walls joined together by a continuous side rim and having a head end and a tail end at opposite locations on said side rim, the top wall having a sound hole therethrough, a longitudinally elongate and cantilevered neck attached to said hollow main body adjacent said head end thereof and projecting outwardly therefrom in substantially parallel relationship with a longitudinally extending axis which extends between the head and tail ends of said hollow main body, a plurality of strings extending along said neck and along said top wall so that the strings extend across the sound hole, said strings having opposite ends thereof attached to said neck and said main body, and a headblock arrangement at said head end of said hollow main body for fixedly attaching a heel part of said neck to said hollow main body, comprising the improvement wherein:

said headblock arrangement comprising a U-shaped headblock engaged between and fixedly connected to said top and bottom walls at said head end, said U-shaped headblock defining a concave recess which projects longitudinally inwardly of said hollow body at said head end in a direction toward said tail end, said concave recess also being formed in said top and bottom walls so as to extend transversely through the entire hollow body, said U-shaped headblock defining a part of said side rim, and said neck projecting into said concave recess, the heel part of said neck being disposed within said concave recess and defining a longitudinal terminal end of said neck, said heel part being abuttingly engaged with and structurally fixedly secured to a bight part of said U-shaped headblock such that said neck does not protect into said sound box and is structurally fixedly secured to said hollow main body solely by the engagement of said heel part with said headblock, said headblock having a pair of cantilevered side leg parts which join to opposite ends of said bight part and which project forwardly from an outer face of said bight part and are positioned in sidewardly spaced relation on opposite sides of said neck to define access spaces on opposite sides of said neck within said concave recess to facilitate access to the strings, said U-shaped headblock having a substantially uniform thickness throughout the length of the bight part and side leg parts thereof, the thickness of said headblock throughout the length of the bight and side leg parts being several times greater than the thickness of said top and bottom walls, the side rim having sidewall rim parts which extend longitudinally and define opposite sidewalls of the hollow main body, said sidewall rim parts having a thickness of a magnitude similar to the thickness of the top and bottom walls, and each said side leg part of the U-shaped headblock having a length so as to project outwardly in the longitudinal direction away from the outer face of the bight part by a distance which at least equals twice the thickness of the bight part of the headblock, whereby the U-shared headblock and its fixed securement between the top and bottom walls can accommodate the force moment imposed therein by the neck.

15. A guitar according to claim 14, wherein the bight and side leg parts of the headblock are joined through smoothly rounded corners so that the headblock is of uniform thickness throughout the length thereof.

16. A guitar according to claim 15, wherein the headblock comprises a one-piece member which is laminated out of wood veneer.

17. A guitar according to claim 15, wherein said headblock has a thickness of about ¾ inch, and wherein the access spaces as defined on opposite sides of said neck each have a width of at least about 2½ inches as defined between the free end of the side leg part and an adjacent side of said neck.

18. An instrument according to claim 1, wherein said headblock is a one-piece member laminated out of wood veneer and has a thickness throughout the length of the bight and side leg parts of about ¾ inch.

19. An instrument according to claim 1, wherein said top and bottom walls have a thickness of about ⅛ inch, said top wall has a sound hole formed therethrough and positioned adjacent but rearwardly a small distance from the headblock and disposed so that the strings pass thereover, said side rim as it extends between said headblock and said tail end having a thickness of about ⅛ inch, and said headblock throughout the length of the bight and side leg parts thereof having a thickness of between about ½ inch and about ¾ inch.

20. An acoustical guitar comprising a hollow main body forming a sound box, said hollow main body being defined by opposed top and bottom walls having a thickness of about ⅛ inch and joined together by a substantially continuous side rim wall which extends between head and tail ends of the guitar and has a thickness of about ⅛ inch, the top wall having a sound hole formed therethrough close to but spaced rearwardly from the head end, a one-piece U-shaped headblock engaged between and fixedly connected to said top and bottom walls at said head end and defining a concave recess which projects longitudinally inwardly of said hollow body at said head end in a direction toward said tail end and which extends transversely through both said top and bottom walls, said U-shaped headblock having a transversely extending bight part which defines a bottom of said recess and which at opposite ends is integrally joined through corners to a pair of cantilevered leg parts which project longitudinally forwardly and define forwardmost extremities of the hollow body, said side leg parts terminating in free ends which are fixedly secured to the side rim, said headblock throughout the length of the bight and side leg parts having a substantially uniform thickness which is in the range of from about ½ inch to about ¾ inch, said side leg parts being cantilevered forwardly beyond the bottom of said recess by a length which is at least twice the thickness of the bight part of the headblock, the hollow body in the interior thereof longitudinally between the head and tail ends being free of obstructions which would interfere with the acoustical properties of the hollow body, a longitudinally elongate neck member having a length which extends between first and second free terminal ends, one of said ends defining a heel part which is disposed within said concave recess and which terminates in a generally flat and transverse end face which abuts a front outer face of the bight part of the head member and is fixedly secured thereto by a fastening structure which constitutes the sole structural connection for fixedly securing the neck member to the hollow body, said neck member at said one end having a transverse width which is substantially smaller than the transverse width of said concave recess so as to define relatively wide access spaces on opposite sides of said neck member between said neck member and said side leg parts to facilitate access to the strings which are anchored adjacent the other end of the neck member and extend along the neck member and along the top wall and pass over the sound hole for connection to the hollow body rearwardly thereof.

21. An instrument according to claim 13, including a pair of lower braces positioned within said hollow body adjacent said bottom wall and engaged with said headblock adjacent a lower edge thereof, said lower braces being sidewardly spaced and disposed in a generally diverging V-shaped configuration as the lower braces project rearwardly from the headblock.

* * * * *

UNITED STATES PATENT AND TRADEMARK OFFICE

CERTIFICATE OF CORRECTION

PATENT NO. : 5 900 561

DATED : May 4, 1999

INVENTOR(S) : Abraham J. Wechter

It is certified that error appears in the above-identified patent and that said Letters Patent is hereby corrected as shown below:

Column 12, line 40; delete in its entirety and replace with ---upper braces and a pair of lower braces are positioned within---.

Column 14, line 21; change "protect" to ---project---.

Signed and Sealed this

Thirteenth Day of June, 2000

*Attest:*

Q. TODD DICKINSON

*Attesting Officer*

*Director of Patents and Trademarks*